United States Patent [19]

Seko et al.

[11] Patent Number: 4,643,818

[45] Date of Patent: Feb. 17, 1987

[54] MULTI-CELL ELECTROLYZER

[75] Inventors: Maomi Seko, Tokyo; Reiji Takemura, Hachiooji; Hideharu Miyamori, Nobeoka, all of Japan

[73] Assignee: Asahi Kasei Kogyo Kabushiki Kaisha, Osaka, Japan

[21] Appl. No.: 760,897

[22] Filed: Jul. 31, 1985

[30] Foreign Application Priority Data

Aug. 7, 1984 [JP] Japan ..... 59-164259
Jul. 4, 1985 [JP] Japan ..... 60-145821

[51] Int. Cl.[4] ..... C25B 9/00; C25B 15/08

[52] U.S. Cl. ..... 204/253; 204/255; 204/257

[58] Field of Search ..... 204/253–258

[56] References Cited

U.S. PATENT DOCUMENTS 1,306,151 6/1919 Kroll ..... 204/256
4,309,264 1/1982 Bender et al. ..... 204/256

*Primary Examiner*—Donald R. Valentine
*Attorney, Agent, or Firm*—Birch, Stewart, Kolasch & Birch

[57] ABSTRACT

A multi-cell electrolyzer comprising a plurality of unit cells, each of which is composed of an anode chamber containing an anode and a cathode chamber containing a cathode and a cation exchange membrane for partitioning said unit cell into said anode chamber and said cathode chamber, and each of which is adapted to have an internal pressure maintained at a level higher than the atmospheric pressure in operation of the electrolyzer, said plurality of unit cells being arranged in series and adapted to be energized through a plurality of current lead plates, and rigid multi-contact electrically conductive means provided between the adjacent unit cells and/or between each current lead plate and the unit cell adjacent thereto, thereby establishing electrical connection between the adjacent unit cells and/or between each current lead plate and the unit cell adjacent thereto. With such a structure, not only is the electrical contact resistance between the adjacent unit cells and between each current lead plate and the unit cell adjacent thereto extremely reduced but also the current density in the unit cells is rendered uniform. Further, the present multi-cell electrolyzer can be easily constructed either in a bipolar form or in a monopolar form using unit cells common to both of the bipolar and monopolar forms.

11 Claims, 13 Drawing Figures

MULTI-CELL ELECTROLYZER

This invention relates to a multi-cell electrolyzer. More particularly, the present invention is concerned with a multi-cell electrolyzer suitable for use in the electrolytic production of an alkali metal hydroxide and chlorine from an aqueous alkali metal chloride solution. The multi-cell electrolyzer of the present invention comprises a plurality of unit cells, each of which is composed of an anode chamber containing an anode and a cathode chamber containing a cathode and a cation exchange membrane for partitioning said unit cell into said anode chamber and said cathode chamber and each of which is adapted to have an internal pressure maintained at a level higher than the atmospheric pressure in operation of the electrolyzer, said plurality of unit cells being arranged in series and adapted to be energized through a plurality of current lead plates, and rigid multi-contact electrically conductive means provided between the adjacent unit cells and/or between each current lead plate and the unit cell adjacent thereto, thereby establishing electrical connection between the adjacent unit cells and/or between each current lead plate and the unit cell adjacent thereto.

Examples of the alkali metal chloride to be electrolyzed by the present electrolyzer include sodium chloride, potassium chloride and lithium chloride. Of them, sodium chloride is the most important one from a commercial point of view. Hereinafter, explanation of the present invention will be made with respect to the electrolysis of an aqueous sodium chloride solution, however, the present invention should, of course, not be limited to the electrolyzer for sodium chloride.

It is well known that the ion exchange membrane electrolyzer for an aqueous sodium chloride solution generally includes two types of electrolyzers, namely, a bipolar system electrolyzer and a monopolar system electrolyzer. With respect to such two types of electrolyzers, there have heretofore been proposed various improvements.

For example, with respect to a bipolar system electrolyzer, there have been proposed an electrolyzer in which the side walls of the adjacent unit cells are explosion-bonded to establish electrical connection between the adjacent unit cells (see, for example, U.S. Pat. No. 4,111,779), an electrolyzer in which a resilient strip is interposed between the adjacent unit cells to provide electrical connection therebetween (see, for example, U.S. Pat. No. 4,108,752), an electrolyzer in which unit cells are made of a plastic material and the adjacent unit cells are electrically connected by means of a bolt and a nut (see, for example, German Pat. No. 2551234), and the like.

With respect to a monopolar system electrolyzer, there has been proposed an electrolyzer in which a plurality of lead rods are inserted in electrolytic cells to perform current distribution (see, for example, Japanese Patent Application laid-open specification No. 52-153877), and an electrolyzer in which the conducting area is reduced and a busbar is directly connected to the end portion of each electrode (see, for example, U.S. Pat. No. 4,252,628).

The heretofore proposed electrolyzers as mentioned above are those which are improved so as to be suitable for use in the ion exchange membrane electrolysis of brine. However, they are still unsatisfactory because they have such disadvantages that complicated procedures are needed for assembling, that electrical contact resistance between the adjacent unit cells is large, that the current density in the electrolytic cell is non-uniform and that high cost is needed for the production thereof.

Further, it is noted that the conventional electrolyzers as mentioned above have a disadvantage that there is not interchangeability between a bipolar type unit cell and a monopolar type unit cell and, therefore, according to the type of electrolyzer, it is necessary to prepare a number of unit cells of the corresponding type separately.

On the other hand, it is known that the power consumption can be extremely reduced if the electrolyzer is operated while maintaining the internal pressure of the electrolytic cell at a pressure higher than the atmospheric pressure (see, for example, U.S. Pat. No. 4,105,515). In the electrolysis conducted by maintaining the internal pressure of the electrolytic cell at a pressure higher than the atmospheric pressure, however, there are still used conventional electrolyzers which have various disadvantages as mentioned above and, therefore, satisfactory effects due to the use of a pressurized cell cannot be practically attained.

Accordingly, it is a primary object of the present invention to provide a multi-cell electrolyzer in which the electrical contact resistance between the adjacent unit cells and/or between each current lead plate and the unit cell adjacent thereto is small and the current density is uniform in the cells and which is easy to assemble and can be produced at low cost.

It is another object of the present invention to provide a multi-cell electrolyzer which can be easily constructed either in a bipolar form or in a monopoler form using unit cells common to both of the bipolar and monopolar forms.

The foregoing and other objects, features and advantages of the present invention will be apparent to those skilled in the art from the following detailed description and appended claims taken in connection with the accompanying drawings in which:

In FIGS. 1 through 13, like parts and portions are designated by like numerals. Further, it should be noted that in FIGS. 1 through 13, in order to make it easy to understand the essential features of the present invention, the dimensional relationships between the respective parts and portions are not exactly shown and each Figure is diagrammatically shown for illustration of the present invention.

According to the present invention, there is provided a multi-cell electrolyzer comprising:

a plurality of unit cells;

each unit cell comprising an anode chamber unit and a cathode chamber unit;

said anode chamber unit comprising a frame wall, a metallic side wall cooperating with said frame wall to make a pan form, and an anode welded with said side wall through a plurality of electrically conductive ribs;

said cathode chamber unit comprising a frame wall, a metallic side wall cooperating with said frame wall to make a pan form, and a cathode welded with said side wall through a plurality of electrically conductive ribs;

a cation exchange membrane disposed between the anode of the anode chamber unit and the cathode of the cathode chamber unit adjacent to said anode chamber unit so that said anode and said cathode face said cation exchange membrane on its opposite sides, respectively;

said plurality of unit cells being arranged in series and adapted to be energized through a plurality of current lead plates; and rigid multi-contact electrically conductive means;

said rigid multi-contact electrically conductive means being provided between the adjacent unit cells and/or between each current lead plate and the unit cell adjacent thereto, thereby establishing rigid firm contact therebetween at a plurality of points; and wherein the electrolyzer is adapted to be operated while maintaining the internal pressure of each unit cell at a level higher than the atmospheric pressure.

Figure 1:
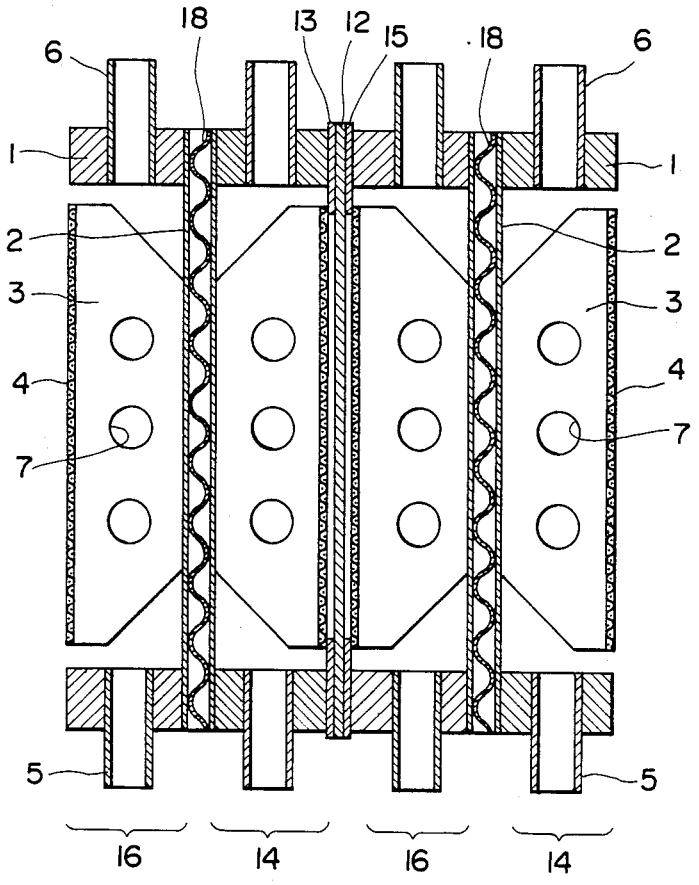
FIG. 1 is a diagrammatic cross sectional view illustrating one embodiment of the present invention.
Figure 2:
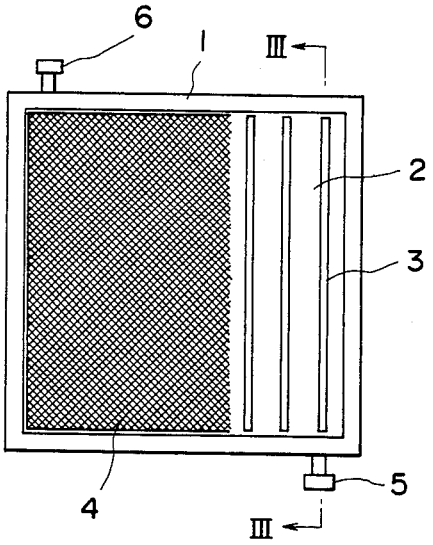
FIG. 2 is a diagrammatic view of one form of a chamber unit to be used commonly as an anode chamber unit and a cathode chamber unit of the embodiment of FIG. 1, viewed from the electrode side, with the electrode partly cut-away.
Figure 3:
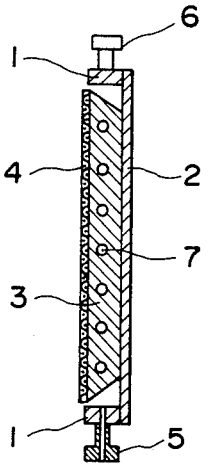
FIG. 3 is a diagrammatic cross sectional view of FIG. 2 taken along the line III—III in FIG. 2.

Referring now to FIGS. 1 to 5, there is shown one embodiment of the present invention which is of a bipolar system. Each of a plurality of unit cells comprises an anode chamber unit 14, a cathode chamber unit 16 and a cation exchange membrane 12 disposed between the anode chamber unit 14 and the cathode chamber unit 16, with the anode 4 and cathode 4 facing the cation exchange membrane 12 on its opposite sides. Each of the anode chamber unit 14 and the cathode chamber unit 16 comprises a frame wall 1, metallic side wall 2 disposed so as to make a pan form (as depicted in FIGS. 2 and 3) in cooperation with the frame wall 1, and an electrode welded with the side wall 2 through a plurality of electrically conductive ribs 3. Each electrically conductive rib 3 has a plurality of holes 7 for passing therethrough an electrolyte solution and an electrolytic product. The frame wall 1 has an inlet 5 for an electrolyte solution on its lower side and an outlet 6 for the electrolyte solution and an electrolytic product on its upper side. The inlet 5 and outlet 6 are respectively connected to a supply header (not shown) for an electrolyte solution and a discharge header (not shown) for the electrolyte solution and an electrolytic product through a flexible hose (not shown). In operation of the electrolyzer, each unit cell is pressurized to maintain the internal pressure at a level higher than the atmospheric pressure.

Figure 4:
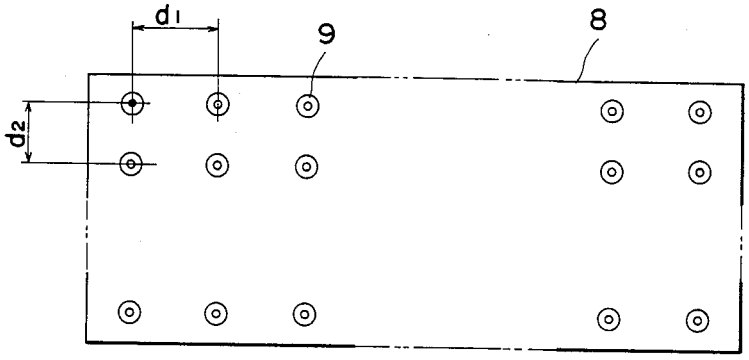
FIG. 4 is a diagrammatic plan view of one form of a rigid electrically conductive sheet having a plurality of protrusions which is in the form a burring.
Figure 6:
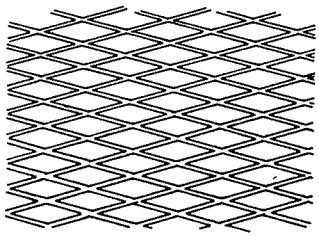
FIG. 6 is a diagrammatic plan view of another form of a rigid electrically conductive sheet having a plurality of protrusions which is in the form of an expanded metal.

As illustrated above and depicted in FIG. 1, a plurality of unit cells are arranged in series. Each cell has on both of its sides the side wall 2 of the anode chamber unit 14 and the side wall 2 of the cathode chamber unit 16, respectively. The side walls 2 and 2 of the adjacent unit cells face each other through a spacing. Between the adjacent unit cells (namely, in the above-mentioned spacing) is provided rigid multi-contact electrically conductive means. In this embodiment, an electrically conductive sheet 18 having a plurality of protrusions is used as the rigid multi-contact electrically conductive means. As the electrically conductive sheet 18, there may, for example, be used a burring shown in FIG. 4. The burring comprises a rigid metallic plate 8 and a number of protrusions 9 formed on the plate 8 by a customary method such as pressing. In the present invention, the term "rigid multi-contact electrically conductive means" is used to intend a means for performing contact with the other body at a plurality of points, which means is electrically conductive and free of resiliency and has such a rigidity that when the means is held between a pair of plates and a pressure of 3 $kgf/cm^2G$ (0.294 MPa) or less is applied onto both sides of the pair of plates having the means held therebetween the means undergoes substantially no deformation or no change in thickness. The rigid multi-contact electrically conductive means has a plurality of protrusions. The rigid multi-contact electrically conductive means is not restricted with respect to kind and shape or form as long as it satisfies the purpose of the present invention. As described above, as the rigid multi-contact electrically conductive means, there may be used a rigid electrically conductive sheet having a plurality of protrusions, such as a burring shown in FIG. 4 and an expanded metal which will be explained later in connection with FIG. 6. Alternatively, the rigid multi-contact electrically conductive means may be constituted by a plurality of protrusions formed on the surface of the side wall of at least one of the adjacent unit cells as will be explained later in connection with FIG. 11. In the case of a specific form of the rigid multi-contact electrically conductive means shown in FIG. 9, care should be paid so that the side wall is not caused to break or to have holes in forming the protrusions on the side wall. In the case of the electrically conductive sheet having a plurality of protrusions such as shown in FIG. 4 and FIG. 6, processing for formation of the sheet is easy to conduct without such a special care as mentioned above. In general, in the multi-contact electrically conductive means, the height of each protrusion may be 1.0 to 4.0 mm, preferably 1.5 to 3.0 mm and the size of each protrusion may be 2 to 10 mm in diameter, preferably 3 to 5 mm in diameter. The protrusions may be distributed at a pitch of 5 to 30 mm, preferably 10 to 20 mm. In the case of the electrically conductive sheet having a plurality of protrusions such as shown in FIG. 4 and FIG. 6, the thickness of the sheet may be 0.3 to 2.0 mm, preferably 0.5 to 1.5 mm.

Referring back to FIG. 1, numeral 18 designates an electrically conductive sheet having a plurality of protrusions such as a burring shown in FIG. 4. The electrically conductive sheet 18 is sandwiched between the adjacent unit cells, more specifically between the side wall 2 of the cathode chamber unit 16 and the side wall 2 of the anode chamber unit 14, so that rigid firm contact is attained between the adjacent unit cells at a plurality of points, thereby establishing electrically connection between the adjacent unit cells through the electrically conductive sheet 18.

A plurality of unit cells are arranged alternately with the electrically conductive sheets 18 and constructed in the form of a filter press type electrolyzer as will be explained in connection with FIG. 12. In the case of the arrangement shown in FIGS. 1 and 12, the electrolyzer is of a bipolar system and includes a pair of current lead plates 19, 19 which are disposed on both ends of the in-series arrangement of the plurality of unit cells, respectively. In this case, the electrically conductive sheet 18 is also provided between each of the current lead plates 19, 19 and the unit cell adjacent thereto, thereby establishing electrical connection between each of the current lead plates 19, 19 and the unit cell adjacent thereto.

As mentioned above, the electrolyzer is operated while maintaining the internal pressure of each of the unit cells at a level higher than the atmospheric pressure and, therefore, both the side walls of each unit cell are expanded outwardly. As a result of this, rigid firm contact between the adjacent unit cells through the electrically conductive sheet 18 and between the each of the current lead plates 19, 19 and the unit cell adjacent thereto through the electrically conductive sheet can be surely attained over the area of the side wall of the unit cell at a plurality of contact points. In this instance, in order to minimize the electrical contact resistance, it is very important to increase the contact pressure. In the present invention, the contact is effected through rigid multi-contact electrically conductive means having a plurality of protrusions and, therefore, the contact pressure at contact points becomes very large with great advantages. This leads to not only minimization of the electrical contact resistance between the adjacent cells and between each of the current lead plates 19, 19 and the unit cell adjacent thereto, but also leads to uniformity of current density distribution in the electrolytic cells. In addition, it should be noted that the present electrolyzer is of a simple construction as mentioned above, and therefore, extremely easy to assemble and can be produced at low cost.

Referring again to FIGS. 2 and 3, there is illustrated one form of a chamber unit to be used commonly as the anode chamber unit and the cathode chamber unit. The thickness of the frame wall 1 is not specifically limited as far as there can be formed the inlet 5 and the outlet 6 and the frame wall has a sufficient strength for the purpose, but in general may be 0.5 to 5.0 cm, preferably 1.0 to 3.0 cm. The raw material of the frame wall to be employed in the present invention is not critical. As the suitable raw material, there may be mentioned, for example, metals such as iron, nickel, titanium and alloys thereof, and plastic materials such as polyethylene, polypropylene and polyvinyl chloride. Of them, however, metals may be preferred from the viewpoints of leakage prevention of the electrolyte solution and improvement of the mechanical strength of the electrolyzer. These advantages may be attained by the use of metals because metals can be welded to the side wall to form a unified structure. Moreover, it may be preferred to use titanium or a titanium alloy as the raw material for the frame wall of the anode chamber unit. On the other hand, as the raw material for the frame wall of the cathode chamber unit, it may be preferred to use iron, nickel or an alloy thereof such as a stainless steel.

The electrically conductive rib 3 is welded with the side wall 2, and the electrode 4 is welded to the electrically conductive rib. Any materials which are inert under electrolytic conditions may be employed for the side wall and the electrically conductive rib. For example, with respect to the anode chamber unit, titanium or a titanium alloy may be employed as the raw material of the side wall and electrically conductive rib. Meanwhile, with respect to the cathode chamber unit, iron, nickel or an alloy thereof such as a stainless steel may be employed as the raw material of the side wall and electrically conductive rib.

It is preferred that the exterior side surface of the side wall 2 be provided with a coating of a metal which exhibits a high electrical conductivity and a low hardness to decrease the electrical contact resistance between the side wall and that adjacent thereto and between the side wall and the current lead plate. As such a metal, there may be mentioned, for example, copper, tin, aluminum and the like. The above-mentioned coating is especially useful when the side wall is made of titanium, because the formation of an oxide film which tends to occur in the case of the titanium-made side wall can be prevented by such coating. The method of providing such coating is not critical. For example, such coating may be provided by customarily employed techniques such as electroless plating, electroplating, melt spraying and vapor deposition.

The side wall is desired to have a thickness such as enables the wall to suitably expand due to the internal pressure of the cell and such as enables the wall to be sufficiently welded with the electrically conductive rib. It is generally preferred that the thickness be in the range of from about 1 to about 3 mm.

The side wall and the frame wall cooperate with each other to make a pan form. Illustratively stated, the side wall may be attached to the frame wall, for example, by welding, bolting, bonding with an adhesive or the like. Of them, welding or bonding with an adhesive may be preferred because they are advantageous in forming a unified structure. In the case where the frame wall is made of a material, such as plastic materials, which do not have a sufficient resistance to the aqueous electrolyte solution or electrolytic product, the side wall may be so constructed that it has at its edge portion a recess adapted to receive the plastic-made frame wall thereinto as will be explained later with respect to FIG. 10.

The electrically conductive rib 3 is formed with holes 7 which serve as passage for an electrolyte solution and electrolytic products. The height (corresponding to the distance between the side wall and the electrode) of the electrically conductive rib 3 is adjusted so that there is almost no space or no space at all between the cation exchange membrane 12 and the electrode 4. In the adjustment of the height of the electrically conductive rib 3, various factors such as the width of the frame wall 1 and the thicknesses of gaskets 13 and 15 and the electrode 4 are taken into consideration. With respect to the positions of electrically conductive ribs, it is preferable that the electrically conductive ribs of the anode chamber unit and those of the cathode chamber unit be disposed in an alternate manner as viewed from the top of the cells. When each of the electrically conductive ribs of the anode chamber unit is disposed in alignment with each of the electrically conductive ribs of the cathode chamber unit as viewed from the top of the cell and the height of the ribs is too large, there is a danger that the cation exchange membrane 12 will be crushed by the cathode and anode at a portion in which the electrically conductive rib in the anode chamber unit faces a conductive rib in the cathode chamber unit through the anode, the membrane and the cathode, thereby causing a short circuit. On the other hand, when the electrically conductive ribs of the anode chamber unit and those of the cathode chamber unit are disposed in an alternate manner as viewed from the top of the cells, even if the height of the electrically conductive ribs is slightly large as compared with that just required for reducing nearly zero the spaces between the membrane and respective electrodes, by changing the shapes of the electrodes and/or the metalic side wall from a flat form to a wave form, not only is a danger that the membrane will be crushed by the cathode and the anode eliminated but also the space between the membrane and the cathode and the space between the membrane and the anode can be reduced to zero.

As the electrode 4, there may be used conventional porous electrodes such as those made of expanded metal, perforated plate, rod, net,etc. Of them, the porous electrode made of perforated plate (perforated plate electrode) is preferable because the spaces between the membrane and the electrodes can be reduced to zero without a danger of impairing the membrane. The perforated plate electrode is an electrode made of a plate provided with a plurality of openings having a circular shape, oval shape, square shape, rectangular shape, cross shape or the like. The openings may usually be formed by punching. The shape of openings is preferably circular because openings having a circular shape can be easily formed by punching. The diameter of the openings may be in the range of from 0.5 to 6 mm, preferably from 1 to 5 mm. The opening rate of the perforated plate electrode may be in the range of from 10 to 70%, preferably from 15 to 60%. When the diameter of openings and the opening rate are too small, the generated gases are difficult to be discharged. On the other hand, when the diameter of openings and the opening rate are too large, the current density in the cation exchange membrane disadvantageously becomes non-uniform.

As the anode, there may be employed anodes usually employed in the electrolysis of an aqueous alkali metal chloride solution. For example, there may be employed an anode comprising a substrate made of titanium, zirconium, tantalum, niobium, or an alloy thereof and an anodically active coating formed on the surface thereof consisting mainly of an oxide of a platinum group metal such as ruthenium oxide or the like.

The cathode to be employed in the electrolytic cells of the present electrolyzer may be made of a metal such as iron, nickel or an alloy thereof, or may be composed of such metal as a substrate and a cathodically active coating formed thereon of Raney nickel, nickel rhodanide, nickel oxide or the like.

Referring back to FIGS. 4 and 5, as described before, the burring is a preferred example of the electrically conductive sheet having a plurality of protrusions to be used as one form of the rigid multi-contact electrically conductive means. Of course, beside the burring shown in FIGS. 4 and 5, various forms of sheets having a plurality of protrusions on its one side or both sides may be used. The thickness of the electrically conductive sheet is not critical but may generally be in the range of about 0.1 to 3 mm. The aforementioned expanded metal and burring may preferably be employed because they are extremely effective for minimizing electrical contact resistance between the adjacent unit cells and between each of the current lead plates and the unit cell adjacent thereto. The electrically conductive sheet is not critical with respect to size, but may preferably extend over the whole area of the side wall 2 of the unit cell and the protrusions may preferably be distributed over the whole area of the side wall 2 of the unit cell. The material of the electrically conductive sheet having a plurality of projections may be any kind of metal which has a high electrical conductivity, such as copper, tin, aluminum, iron, nickel and an alloy thereof such as a stainless steel.

The gasket 13 for the anode chamber and the gasket 15 for the cathode chamber serve to seal each of the chambers against leakage of the electrolyte solution. In the case where the surface of the cation exchange membrane is so plane as to provide the sealing property against the electrolyte solution, one or both of these gaskets may be omitted.

Any material having chlorine gas resistance and elasticity may be used to form the gasket 13 for the anode chamber. Preferred examples of the material are a chloroprene rubber, a fluororubber, a silicone rubber and the like. As the suitable material for the gasket 15 for the cathode chamber, there may be mentioned, for example, an ethylene propylene rubber, a chloroprene rubber, a butyl rubber, a fluororubber and the like. The gasket 13 or 15 may be reinforced with a reinforcing cloth.

The thickness of the gasket to be used in the present invention is desirably to be one which is sufficient to completely seal the electrolyte solution. The suitable thickness depends on the hardness of the gasket. However, it is generally in the range of from about 0.5 to about 3 mm.

The cation exchange membrane 12 to be used in the present invention is not especially limited, and there may be employed any membrane generally used for the electrolysis of an aqueous alkali metal chloride solution.

With respect to the type of the resin of the cation exchange membrane, there may be employed, for example, resins of a sulfonic acid type, a carboxylic acid type, a sulfonamide type and a combination type of carboxylic acid and sulfonic acid. Of them, the combination type of carboxylic acid and sulfonic acid is especially preferred, which gives a high transference number of an alkali metal. In the case of the combination type, the cation exchange membrane may most preferably be disposed between the anode of the anode chamber unit and the cathode of the cathode chamber unit so that the anode faces the cation exchange membrane on its one side where sulfonic acid groups are present and that the cathode faces the membrane on the other side where carboxylic acid groups are present. With respect to the resin matrix of the cation exchange membrane, fluorocarbon resins are advantageous from the viewpoint of chlorine resistance. The membrane may be reinforced with a cloth, netting or the like in order to increase the strength of the membrane.

Figure 7:
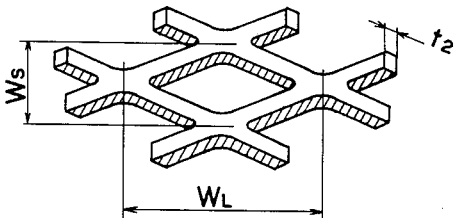
FIG. 7 is a diagrammatic enlarged perspective view of one section of the expanded metal of FIG. 6.

Referring now to FIG. 6, there is shown an expanded metal to be used in another preferred form of a rigid electrically conductive sheet having a plurality of protrusions. FIG. 7 illustrates a diagrammatic enlarged perspective view of one section of the expanded metal of FIG. 6. The expanded metal may preferably be employed in the present invention and extremely effective for minimizing electrical contact resistance.

Figure 8:
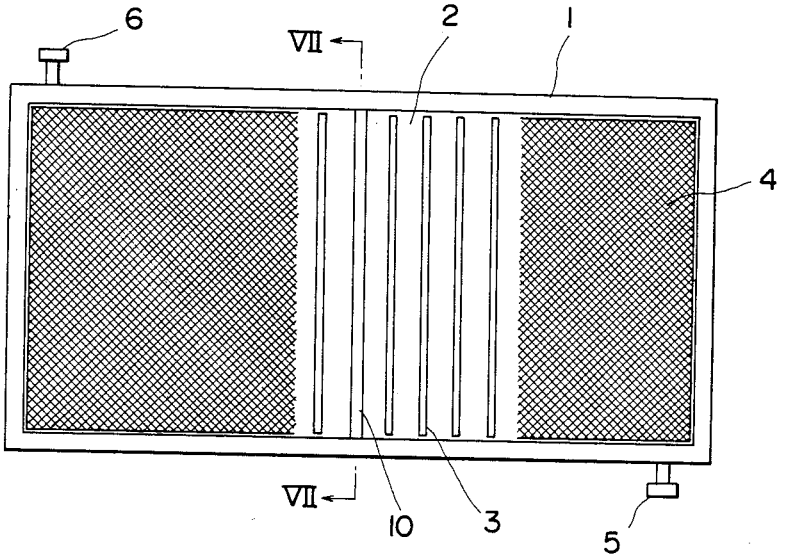
FIG. 8 is a diagrammatic view of another form of a chamber unit to be used commonly as an anode chamber unit and a cathode chamber unit of the embodiment of FIG. 1, viewed from the electrode side, with the electrode partly cut-away.
Figure 9:
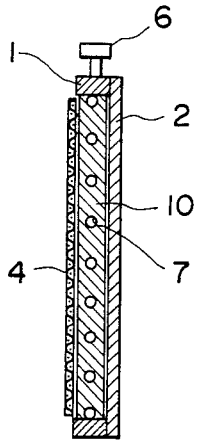
FIG. 9 is a diagrammatic cross sectional view of FIG. 8 taken along the line VII—VII of FIG. 8.

In FIG. 8, there is shown a chamber unit having a frame wall with a side length as large as 1 m or more. In this case, if a reinforcement rib 10 is provided between the upper side and the lower side of the frame wall 1 at a central portion, the thicknesses of the side wall 2 and the frame wall can advantageously be reduced. In FIG. 9 is shown a diagrammatic cross sectional view of FIG. 8 taken along the line VII—VII of FIG. 8. The reinforcement rib 10 is welded or fixed by means of a bolt at its one end with the upper side of the frame wall 1 and at the other end thereof with the lower side of the frame wall 1. The reinforcement rib 10 has holes 7 for passing an aqueous electrolyte solution and an electrolytic product. It is preferred that the reinforcement rib 10 be not welded with the side wall 2. If the rib 10 is welded with the side wall 2, the outward expansion of the side wall of the unit cell due to the internal pressure of the unit cell becomes insufficient, leading to increase in electrical contact resistance between the adjacent unit cells and between each of the current lead plates and the unit cell adjacent thereto.

Figure 10:
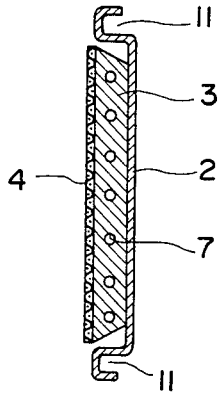
FIG. 10 is a diagrammatic cross sectional view of still another form of a chamber unit in which the side wall has, at its edge portion, a recess for receiving a frame wall made of a synthetic resin material.

In FIG. 10 is shown a diagrammatic cross sectional view of still another form of a chamber unit in which the frame wall is made of a material, such as a plastic material, having an insufficient resistance to the aqueous electrolyte solution or electrolytic product. In this case, the metallic side wall is so constructed that it has at its edge portion a recess 11 adapted to receive the plastic-made frame wall (not shown) thereinto. The recess portion of the metallic side wall may be formed by pressing, drawing or the like.

Figure 11:
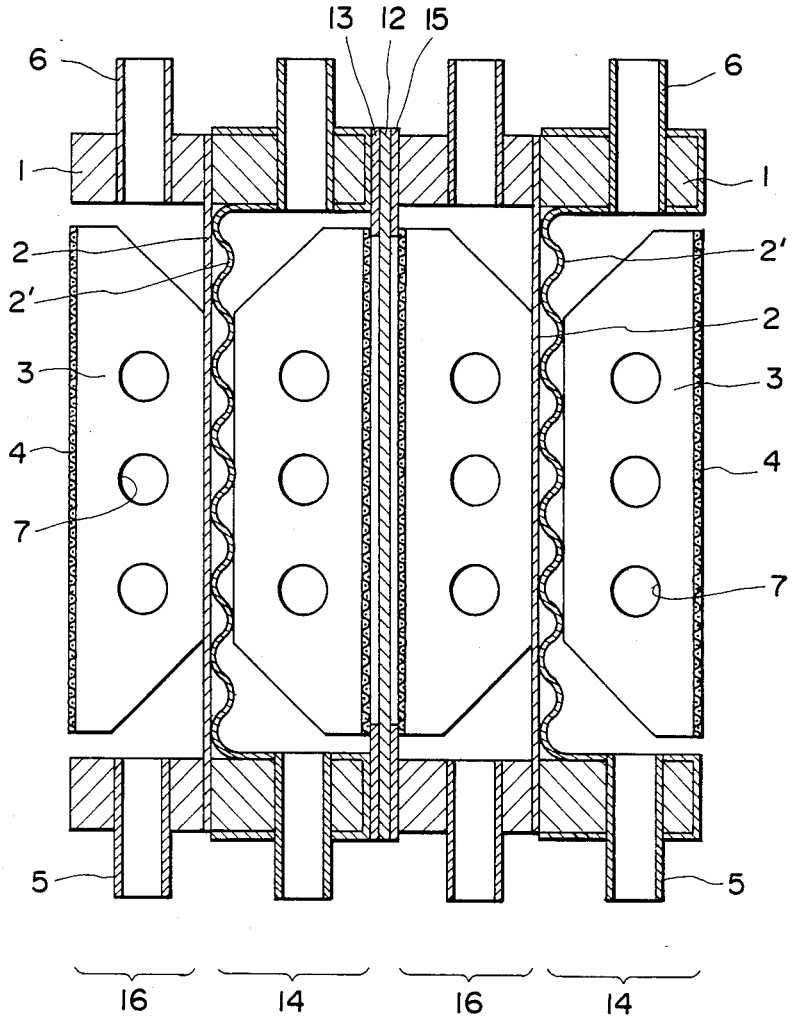
FIG. 11 is a diagrammatic cross sectional view illustrating another embodiment of the present invention in which rigid multi-contact electrically conductive means provided between the adjacent unit cells is in the form of protrusions formed on the surface of the side wall of one of the adjacent unit cells.

In FIG. 11 is shown a diagrammatic cross sectional view illustrating another embodiment of the present invention in which the rigid multi-contact electrically conductive means provided between the adjacent unit cells is in the form of protrusions formed on the surface of the side wall of one of the adjacent unit cells. By employing such a structure, the additional provision of an electrically conductive sheet having a plurality of protrusions becomes unnecessary. The protrusions 2 are brought into contact with the opposite side wall 2, thereby establishing electrical connection therebetween. Both side walls of the unit cell may be similarly processed to have protrusions.

Figure 12:
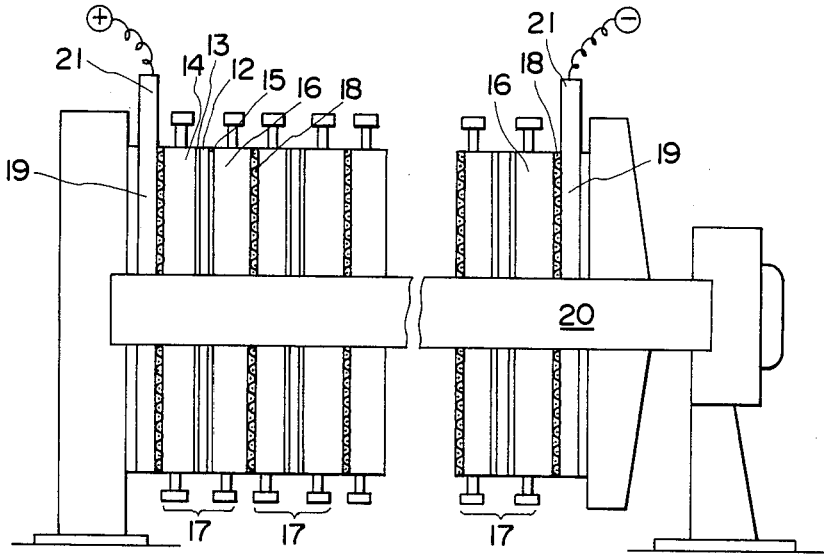
FIG. 12 is a diagrammatic side view of one form of the electrolyzer of the present invention which is of a bipolar system and constructed in the form of a filter press type assembly.

Referring now to FIG. 12, there is shown a diagrammatic side view of one form of the electrolyzer of the present invention which is of a bipolar system and constructed in the form of a filter press type assembly. On one side of the cation exchange membrane 12 is disposed the cathode chamber unit 14 through the gasket 13. On the opposite side of the cation exchange membrane 12 is disposed the anode chamber unit 16 through the gasket 15. Thus, the parts 12, 13, 14, 15 and 16 constitute a unit cell 17. A plurality of the unit cells 17 are arranged alternately with the electrically conductive sheets 18 having a plurality of protrusions disposed therebetween in such a manner that the side wall 2 of each anode chamber unit 16 faces the side wall 2 of each cathode chamber unit 14. On both ends of the inseries arrangement of the electrolytic cells are disposed the current lead plates 19 and 19, respectively, and the unit cells and the current lead plates are clamped by means of a filter press fastening frame to build a filter press type electrolyzer of a bipolar system of the present invention. The current lead plate 19 may have the same size as that defined by the peripheral edge of the frame wall so that the current lead plate is brought into contact with the side wall in its whole area to render uniform the current density in the unit cells, and has its upper connection portion 21 connected to a rectifier through a busbar. The thickness of the current lead plate may be determined so as to increase a little the ohmic loss, taking into consideration the area through which the current passes and the current density.

As the suitable material for the current lead plate, there may be mentioned metals with a high electrical conductivity, such as copper, aluminum and the like.

In operation of the electrolyzer of the present invention, as described above, the internal pressure of each of the unit cells is maintained at a level higher than the atmospheric pressure. The method of pressurizing the unit cell is not specifically limited. For example, the discharge passages for chlorine gas and hydrogen gas may be provided with a pressure regulating valve so that the gas pressure is applied to the interior of the unit cell, or the internal pressure of the unit cell may be suitably adjusted by regulating the circulation volume of the anolyte and the catholyte to be supplied to the electrolytic cell. The unit cell is pressurized to a level of 0.2 to 3 $kg/cm^2G$, preferably 0.5 to 2.0 $kg/cm^2G$. If the internal pressure of the unit cell is too low, the pressure of contact between the adjacent unit cells and between each of the current lead plates and the unit cell adjacent thereto becomes insufficient, leading to increase in electrical contact resistance. On the other hand, if the internal pressure of the unit cell is too high, it is necessary to render the construction of the electrolyzer resistant to extremely high pressure, leading to high cost with disadvantages.

The above explanation is made mainly with respect to a bipolar system electrolyzer, however, the present invention may also be useful for a monopolar system electrolyzer.

Figure 13:
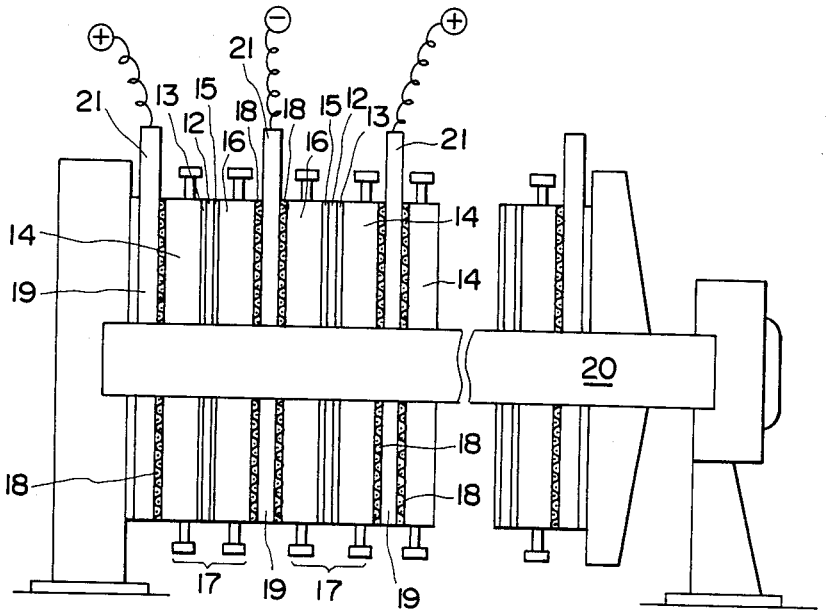
FIG. 13 is a diagrammatic side view of another form of the electrolyzer of the present invention which is of a monopolar system and constructed in the form of a filter press type assembly.

Referring now to FIG. 13, there is shown a diagrammatic side view of another form of the electrolyzer of the present invention which is of a monopolar system and constructed in the form of a filter press type assembly. In this type of electrolyzer, a plurality of unit cells 17 are arranged alternately with the current lead plates 19 disposed therebetween. Between the side walls of a pair of anode chamber units 17 is interposed the current lead plate 19. Between each side wall and the current lead plate 19 is provided rigid multi-contact electrically conductive means to establish electrical connection therebetween. Similarly, between the side walls of the cathode chambers is interposed the current lead plate 19 through rigid multi-contact electrically conductive means to establish electrical connection therebetween. Then, the electrolyzer is energized through each current lead plate.

As described, according to the present invention, not only is the electrical contact resistance between the adjacent unit cells and between each of the current lead plates and the unit cell adjacent thereto extremely reduced but also the current density in the unit cells is rendered uniform and, therefore, the present electrolyzer can be operated at a current density as high as 30A/dm$^2$ or more. In the converntional electrolyzer in which a resilient contact means is provided between the adjacent unit cells, there cannot be obtained high contact pressure between the adjacent unit cells due to the cushioning action as opposed to the case of the electrolyzer of the present invention.

The present invention will be illustrated in more detail with reference to the following Application Examples, which should not be construed to be limiting the scope of the present invention.

EXAMPLE 1

A bipolar system multi-cell electrolyzer similar to that shown in FIG. 12 is composed of a couple of the following unit cells, cation exchange membranes, three rigid multi-contact electrically conductive sheets and a pair of current lead plates.

Each of the unit cell comprises an anode chamber unit and a cathode chamber unit. The size of the anode chamber unit is the same as that of the cathode chamber unit. That is, the frame wall of the chamber unit is 2400 mm in width, 1200 mm in height and 20 mm in thickness. The depth of each side of the frame wall is 20 mm. The frame wall for an anode chamber unit is made of titanium, and the frame wall for a cathode chamber unit is made of a stainless steel. The frame wall of each of the anode chamber unit and cathode chamber unit is reinforced by a reinforcing rib of 20 mm in height, 5 mm in width and 1160 mm in length. The reinforcing rib is welded at its both ends respectively with the inner surface of the upper side of the frame wall and the inner surface of the lower side of the frame wall at a middle position of each of the upper and lower sides. The reinforcing rib has ten 8 mm-diametered holes for passing therethrough an electrolyte solution and electrolytic products. The holes are arranged longitudinally on the reinforcing rib.

The metallic side wall of each of the anode chamber units is 2400 mm in width, 1200 mm in height and 2 mm in thickness, and is welded with the frame wall so that the metallic side wall cooperates with the frame wall to make a pan form.

The chamber unit has a plurality of electrically conductive ribs welded with the frame wall and the metallic side wall. The electrically conductive ribs are welded with the frame wall and the side wall in such an arrangement that the electrically conductive ribs are placed at spaced intervals of 12 cm in parallel with the short side of the frame wall, and that the electrically conductive ribs for the anode chamber unit and the electrically conductive ribs for the cathode chamber unit are placed in an alternate manner as viewed from the top of the cells.

Each of the electrically conductive ribs for the anode chamber unit is 20 mm in height, 5 mm in width and 1160 mm in length, and each of the electrically conductive ribs for the cathode chamber is 22 mm in height, 5 mm in width and 1160 mm in length. Each of the electrically conductive ribs has 10 holes having a diameter of 8 mm so that the electrolyte solution and the electrolytic products can be passed through the holes. The holes are arranged longitudinally of the electrically conductive ribs.

The metalic side wall and the electrically conductive ribs are made of the same material as that of the frame wall. That is, the metallic side wall and electrically conductive ribs for the anode chamber are made of titanium, and the metallic side wall and electrically conductive ribs for the cathode chamber unit are made of a stainless steel. The outer surface of the metallic side wall of the anode chamber unit is plated with copper by electroless plating.

An anode is prepared by boring a titanium plate to have 2 mm-diametered holes at a pitch of 3 mm in a zigzag arrangement and plating the surface of the titanium plate with an oxygen-containing solid solution composed of ruthenium, iridium, titanium and zirconium. The anode has a size of 272 dm$^2$. The anode is welded with the side wall through a plurality of the electrically conductive ribs.

A cathode was prepared by boring a stainless steel plate to have 2 mm-diametered holes at a pitch of 3 mm in a zigzag arrangement. The size of the cathode is the same as that of the anode.

As the rigid electricially conductive sheet, there is used an expanded metal as shown in FIG. 6 and FIG. 7 which has been prepared from a stainless steel plate having a thickness ($t_2$) of 1.5 mm. The short axis ($W_S$), the long axis ($W_L$) and the height of the expanded metal are 7 mm, 14 mm and 3 mm, respectively. The size of the expanded metal is the same as the area defined by the outer periphery of the frame wall.

A copper plate having a thickness of 4 mm is used as the current lead plate.

A gasket for the anode chambers and a gasket for the cathode chambers are prepared from a fluororubber having a thickness of 0.5 mm and an ethylene propylene rubber having a thickness of 2.5 mm, respectively. The shape and size of each gaskets are the same as those of the frame wall.

The cation exchange membrane used is produced as follows.

Tetrafluoroethylene is copolymerized with perfluoro-4,7-dioxy-5-methyl-8-nonenesulfonylfluoride to obtain two kinds of polymers, i.e. Polymer 1 having an equivalent weight of 1300 and Polymer 2 having an equivalent weight of 1130.

The thus obtained polymers are heat molded to obtain a laminate of a 35 $\mu$-thick sheet of Polymer 1 and a 100 $\mu$-thick sheet of Polymer 2. A woven textile prepared from Teflon (polytetrafluoroethylene) is embedded into the laminate on the side of the layer of Polymer 2 by the vacuum laminating method. The resulting laminate is saponified to obtain a sulfonic acid type ion exchange membrane. The layer comprising Polymer 1 sheet of the ion exchange membrane is subjected to reduction treatment for the conversion of the sulfonic acid groups to carboxylic acid groups. Thus, there is obtained a cation exchange membrane.

An electrolytic cell is assembled in a similar manner as shown in FIG. 12 so that the carboxylic acid side of the cation exchange membrane faces the cathode.

The electrolysis of a sodium chloride solution is effected as follows. A solution containing 310 g/liter of sodium chloride is fed to the anode chamber so that the concentration of sodium chloride of the solution at the outlet is 175 g/liter. On the other hand, a diluted sodium hydroxide solution is fed to the cathode chamber so that the concentration of sodium hydroxide of the solution at the outlet is 30% by weight. The other conditions of the electrolysis are as follows.

Temperature for electrolysis: 90° C.

Current density: 40 A/dm$^2$

Pressure at the outlet of the cathode chamber: 1.82 kgf/cm$^2$G

Pressure at the outlet of the anode chamber: 1.46 kgf/cm$^2$G

In the electrolysis, the current efficiency and cell voltage are 96.0% and 6.7 V, respectively.

EXAMPLE 2

Figure 5:
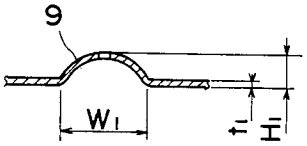
FIG. 5 is a diagrammatic enlarged side view of the protrusion of the burring of FIG. 4.

The electrolysis of a sodium chloride solution is effected in substantially the same manner as in Example 1, except the in place of the expanded metal, a burring as shown in FIG. 4 and FIG. 5 is used as the rigid electrically conductive sheet. The burring comprises a 0.8 mm-thick($t_1$) stainless steel plate 8 having, on its one side, a plurality of protrusions 9 having a diameter ($W_1$) of 3 mm and a depth ($H_1$) of 2 mm. The protrusions are arranged at a pitch ($d_1$) of 20 mm and a pitch ($d_2$) of 17.5 mm. Each of the protrusions has at its apex an opening having a diameter of 1 mm.

In the electrolysis, the current efficiency and cell voltage are 96.0% and 6.6 V, respectively.

What is claimed is:

1. A multi-cell electrolyzer comprising:

a plurality of unit cells;

each unit cell comprising an anode chamber unit and a cathode chamber unit;

said anode chamber unit comprising a frame wall, a metallic side wall cooperating with said frame wall to make a pan form, and an anode welded with said side wall through a plurality of electrically conductive ribs;

said cathode chamber unit comprising a frame wall, a metallic side wall cooperating with said frame wall to make a pan form, and a cathode welded with said side wall through a plurality of electrcially conductive ribs;

a cation exchange membrane disposed between the anode of the anode chamber unit and the cathode of the cathode chamber unit adjacent to said anode chamber unit so that said anode and said cathode face said cation exchange membrane on its opposite sides, respectively;

said plurality of unit cells being arranged in series and adapted to be energized through a plurality of current lead plates; and rigid multi-contact electrically conductive means;

said rigid multi-contact electrically conductive means having such a rigidity that when the conductive means is held between a pair of plates and a pressure of 3 kgf/cm$^2$G (0.294 MPa) or less is applied onto both sides of the pair of plates having the means held therebetween, the conductive means undergoes substantially no deformation or no change in thickness and being provided between the adjacent unit cells and/or between each current lead plate and the unit cell adjacent thereto, thereby establishing rigid firm contact therebetween at a plurality of points; and wherein the electrolyzer is adapted to be operated while maintaining the internal pressure of each unit cell at a level higher than the atmospheric pressure.

2. An electrolyzer according to claim 1, wherein said rigid multi-contact electrically conductive means is constituted by a plurality of protrusions formed on the surface of at least one of the side walls of the unit cell.

3. An electrolyzer according to claim 2, wherein the internal pressure of each unit cell is maintained at a pressure of 0.5 to 2.0 kg/cm$^2$G.

4. An electrolyzer according to claim 2, wherein the internal pressure of each unit cell is maintained at a pressure of 0.2 to 3 kg/cm$^2$G.

5. An electrolyzer according to claim 1, wherein said rigid multi-contact electrically conductive means is in the form of a rigid electrically conductive sheet having a plurality of protrusions and is held between the adjacent unit cells and/or between each current lead plate and the unit cell adjacent thereto.

6. An electrolyzer according to claim 5, wherein said rigid electrically conductive sheet having a plurality of protrusions is in the form of a burring or an of expanded metal.

7. An electrolyzer according to claim 6, wherein the internal pressure of each unit cell is maintained at a pressure of 0.5 to 2.0 kg/cm$^2$G.

8. An electrolyzer according to claim 6, wherein the internal pressure of each unit is maintained at a pressure of 0.2 to 3 kg/cm$^2$G.

9. An electrolyzer according to claim 5, wherein the internal pressure of each unit cell is maintained at a pressure of 0.5 to 2.0 kg/cm$^2$G.

10. An electrolyzer according to claim 5, wherein the internal pressure of each unit is maintained at a pressure of 0.2 to 3 kg/cm$^2$G.

11. An electrolyzer according to claim 1, wherein the internal pressure of each unit cell is maintained at a pressure of 0.2 to 3 kg/cm$^2$G.

* * * * *